United States Patent [19]

Secrist et al.

[11] 4,443,314

[45] Apr. 17, 1984

[54] ANODE ASSEMBLY FOR MOLTEN SALT ELECTROLYSIS

[75] Inventors: Duane R. Secrist, Elizabethton; James M. Clark, Johnson City; Henry E. Grindstaff, Elizabethton, all of Tenn.

[73] Assignee: Great Lakes Carbon Corporation, New York, N.Y.

[21] Appl. No.: 475,951

[22] Filed: Mar. 16, 1983

[51] Int. Cl.[3] ..... C25C 3/06; C25C 3/12; C25C 3/16

[52] U.S. Cl. ..... 204/243 R; 204/279; 204/286; 204/291

[58] Field of Search ..... 204/67, 243 R, 243 M, 204/244, 245, 246, 247, 279, 286, 291, 292; 75/230, 232, 234, 246; 339/278 L; 419/19, 42, 31, 53; 264/60, 61, 104

[56] References Cited

U.S. PATENT DOCUMENTS

| | | | |
|---|---|---|---|
| 3,215,615 | 11/1965 | Ransley | 204/279 |
| 3,328,280 | 7/1967 | Richards et al. | 204/243 R |
| 3,676,079 | 7/1972 | Morgan | 419/19 |
| 4,039,417 | 8/1977 | Sasaki et al. | 204/291 |
| 4,155,757 | 5/1979 | Hing | 75/232 |
| 4,183,746 | 1/1980 | Pearce et al. | 75/234 |
| 4,357,226 | 11/1982 | Alder | 204/286 |

FOREIGN PATENT DOCUMENTS

| | | | |
|---|---|---|---|
| WO81/02027 | 7/1981 | PCT Int'l Appl. | 204/243 R |
| 606901 | 5/1978 | U.S.S.R. | 204/243 R |

OTHER PUBLICATIONS

Accorsi et al., Cermet Cathoder for High Temperature Water Electrolysis with Zirconia Cells, Electrochemical Science & Tech., J. Electrochem. Soc., 4–80.

*Primary Examiner*—R. L. Andrews
*Assistant Examiner*—Terryence Chapman
*Attorney, Agent, or Firm*—Adrian J. Good

[57] ABSTRACT

An improved anode assembly for an aluminum electrolysis cell is formed by the process of shaping an anode 10 and a cermet connector 12 from powders, machining said articles, and sintering said articles. The cermet connector mates with the anode via a threaded joint located at its region of high temperature 14 during operation thereof to avoid excessive ohmic losses. Mechanical support can be provided by the threaded joint or through the use of separate mechanical suspension bars 22.

10 Claims, 4 Drawing Figures

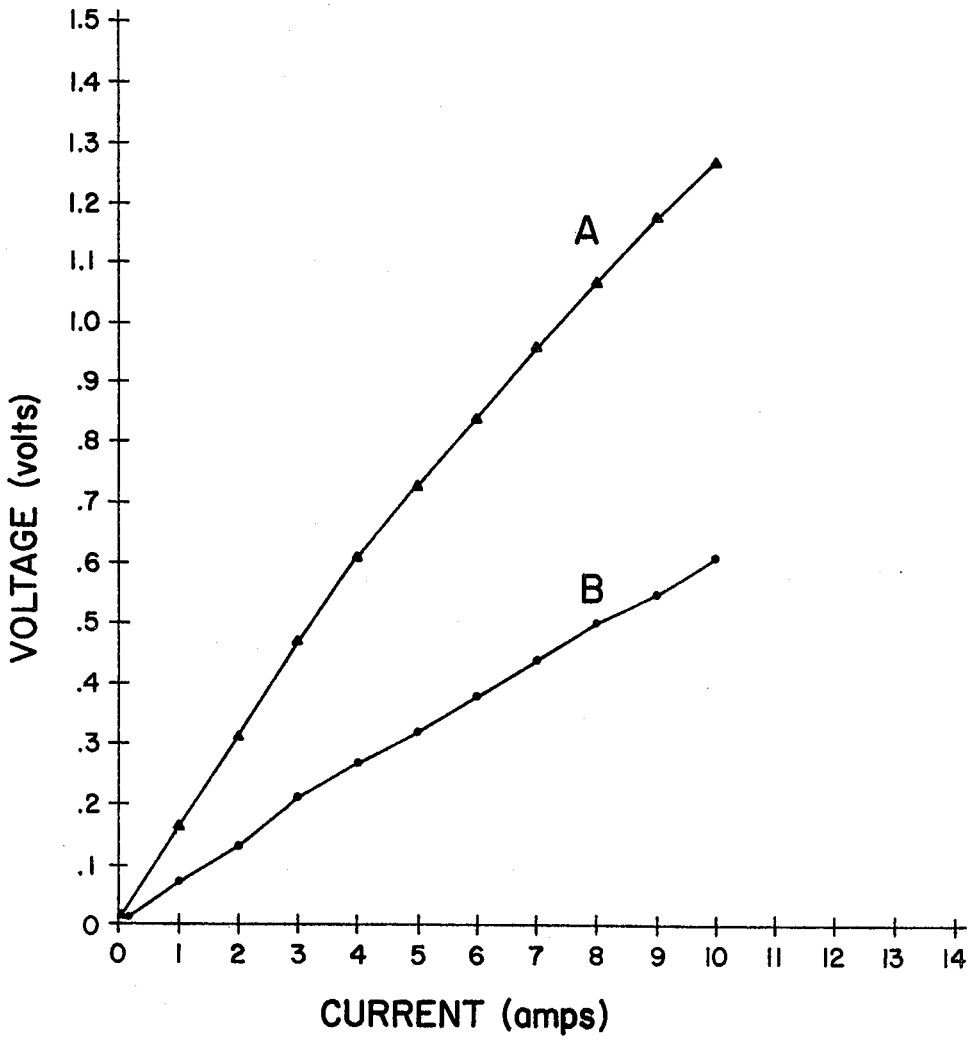
· Fig. 1 ·

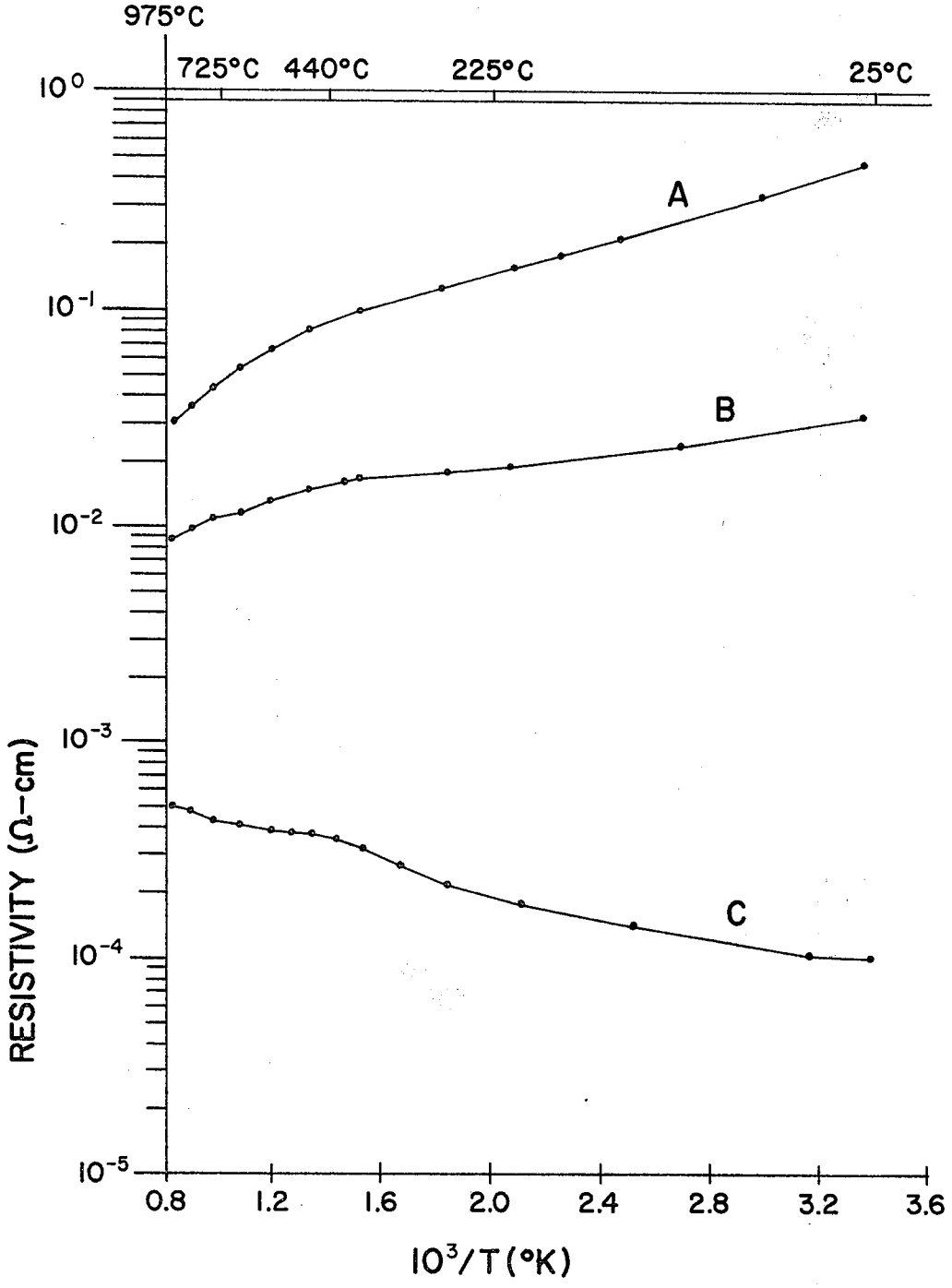
· Fig. 2 ·

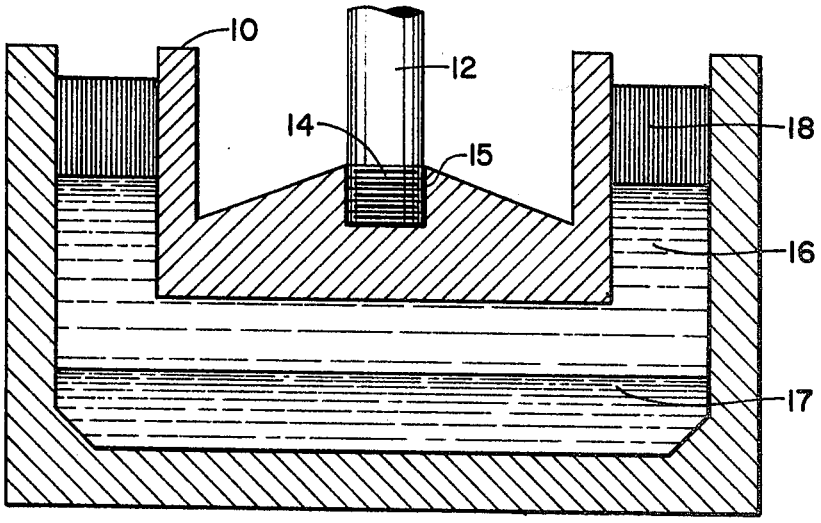
· Fig. 3 ·
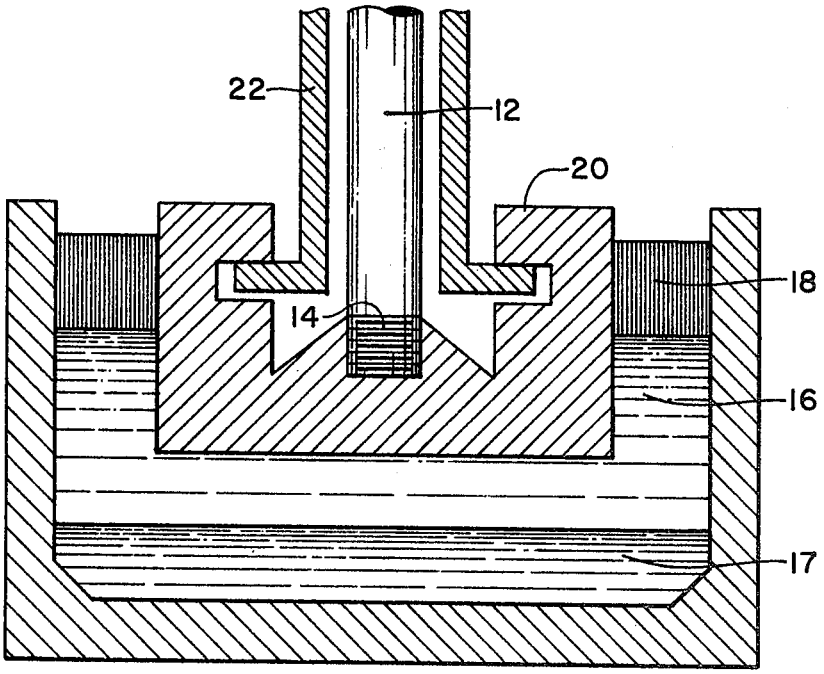
· Fig. 4 ·

ANODE ASSEMBLY FOR MOLTEN SALT ELECTROLYSIS

DESCRIPTION

BACKGROUND OF THE INVENTION

Aluminum is produced in Hall-Heroult cells by the electrolysis of alumina in molten cryolite, using conductive carbon electrodes. During the reaction the carbon anode is consumed at the rate of approximately 450 kg/mT of aluminum produced under the overall reaction $$2Al_2O_3 + 3C \xrightarrow[Na_3AlF_6]{940°-1000° C.} 4Al + 3CO_2.$$

The problems caused by the consumption of the anode carbon are related to the cost of the anode consumed in the reaction above and to the impurities introduced to the melt from the carbon source. The petroleum cokes used in the anodes generally have significant quantities of impurities, principally sulfur, silicon, vanadium, titanium, iron and nickel. Sulfur is oxidized to its oxides, causing particularly troublesome workplace and environmental pollution. The metals, particularly vanadium, are undesirable as contaminants in the aluminum metal produced. Removal of excess quantities of the impurities requires extra and costly steps when high purity aluminum is to be produced.

If no carbon is consumed in the reduction the overall reaction would be $2Al_2O_3 \rightarrow 4Al + 3O_2$ and the oxygen produced could theoretically be recovered, but more importantly no carbon is consumed at the anode and no contamination of the atmosphere or the product would occur from the impurities present in the coke.

Attempts have been made in the past to use non-consumable anodes with little apparent success. Metals either melt at the temperature of operation, or are attacked by oxygen or by the cryolite bath. Ceramic compounds such as oxides with perovskite and spinel crystal structures usually have too high electrical resistance or are attacked by the cryolite bath.

One of the problems arising in the development of conductive ceramic anodes has been caused by the difficulty of making a durable electrical connection between the anode and the current conductor. Previous efforts in the field have produced connectors, primarily of metals such as silver, copper, and stainless steel. Can, U.S. Pat. No. 3,681,506, discloses a resilient metal washer held in place to form an electrical connection. Davies, U.S. Pat. No. 3,893,821, discloses a contact material containing Ag, La, $SrCrO_3$ and CdO. Douglas et al., U.S. Pat. No. 3,922,236, disclose a contact material containing Ag, Cu, La, and $SrCrO_3$. Fletcher, U.S. Pat. No. 3,990,860, discloses cermet compositions containing stainless steel or Mo in a matrix of $Cr_2O_3$ and $Al_2O_3$. Shida et al., U.S. Pat. No. 4,141,727, disclose contacts of Ag, $Bi_2O_3$, $SnO_2$ and Sn. Schirnig et al., U.S. Pat. No. 4,247,381, disclose an electrode useful for $AlCl_3$ electrolysis comprising a graphite pipe, a metallic conductor with a melting point below the bath temperature, and a protective ceramic pipe surrounding the former. West German 1,244,343, U.S. Ser. No. 729,621, discloses borides or carbides of Ti, Zr, Ta, or Nb cast of Al using a flux of $Li_3AlF_6$, $Na_3AlF_6$ and NaCl. Alder, U.S. Pat. No. 4,357,226, discloses an anode assembly for a Hall cell comprising individual units mechanically held together by a clamping arrangement.

There have been several lines of development concerning non-consumable anodes, with ceramics such as stannic oxide compounds, spinels, perovskites and various cermets as principal materials under study. A cermet is a composite material containing both metal and ceramic phases. All of these need some method for connecting to the current conductor.

SUMMARY OF THE INVENTION

Our invention is an electrode assembly for use in molten salt electrolysis, particularly useful for the production of aluminum in Hall-Heroult reduction cells. The assembly has a non-consumable anode, which is electrically connected to a current source, e.g., the anode riser bar, by a cermet stub. The anode can be mechanically supported by the cermet stub, or alternatively by mechanical suspension bars attached to the interior or exterior of the anode. The anode is preferably a conductive ceramic but may also be a cermet composition.

In one case, the anode is supported by mechanical suspension bars which engage slots in the inner wall of the anode. The slots are usually formed in the anode before firing. Placement of the slots and the suspension bars in the interior of the anode affords the bars greater protection from corroding fluoride vapors than attachment to the exterior of the anode. In addition, anode packing is more efficient with an interior support.

Since most ceramic oxides and cermets with low metal contents have steep negative temperature-resistance curves, i.e., the electrical resistances are higher at ambient than operating temperatures, the connection to the current conductor is preferably made in a region of high temperature to avoid severe ohmic losses in the anode. Metals, with the exception of costly precious metals, corrode at this high temperature and are therefore less desirable as candidates for connectors.

Our invention is an anode produced by an improved process with a cermet connector stub. Cermets generally have good electrical conductivity over a wide temperature range, being composed of metals with good conductivity at ambient and lower temperatures and of ceramics which, when carefully chosen and produced, can have good conductivity at high temperatures. Typically, cermets with $\geqq 30$ vol. % metal content exhibit conductivities approaching that of the metal phase while maintaning high corrosion resistance, provided that the cermet body is impervious, i.e., contains less than approximately 8 vol. % porosity. Cermets with from 15–50% vol. % metal may be useful as anode connectors, with $\geqq 30$ vol. % being preferred.

For use in a Hall-Heroult cell, a cermet must have good conductivity across a wide temperature range, good oxidation stability, and high corrosion resistance, particularly to fluoride fumes. When used as a connector, the cermet should have better conductivity at the operating temperature than the anode. Metal-metal oxide combinations are desirable for use with oxide-based anode compositions for long term compatibility between the connector and the anode at the cell temperature. Cermets with a non-oxide ceramic phase may also be useful provided the oxide which forms on the surface of the cermet during operation at high temperature is sufficiently electrically conductive. A protective sheath may be placed over the cermet connector to provide additional protection from fluoride fumes.

The cermets are prepared conventionally by blending the ceramic powder with a metal. A cermet anode or connector may be formed by molding the ceramic and metal powder mixture at about 5–30×$10^7$ Pa, calcining the molded part at about 800°–1100° C., machining the part to a final shape, and sintering the machined part at a temperature above about 1100° C. effective to produce a physically strong part with low porosity, 8 vol. % or lower, and good electrical conductivity across a wide temperature range.

The connector may be joined to the electrode by a threaded joint, or by other designs affording positive physical and electrical contact.

DETAILED DESCRIPTION OF THE INVENTION

Cermets comprising Ni and MnZn ferrite containing 16–40% by volume Ni metal were fabricated. The MnZn ferrite powder used in this study was prepared by conventional wet milling of $MnCO_3$, ZnO, and $Fe_2O_3$. The dried powders were calcined in air at 1000° C. for 2 hours to yield a final composition corresponding to 52 mole % $Fe_2O_3$, 25 mole % MnO, and 23 mole % ZnO. The cermet compositions were mixed by dry blending MnZn ferrite powder with 40μ size (−325 mesh) nickel powder. Samples were then isostatically pressed and sintered in vacuum or nitrogen for 2–24 hours at 1225° C. to produce a dense, low porosity article. Examination of the micro-structures revealed one nickel metal phase and three ceramic phases consisting of mixed ferrites or solid solutions of Mn ferrite, Ni ferrite, and Zn ferrite. The X-ray diffraction lines most closely matched those of nickel zinc ferrite, with several strong lines unidentifiable.

Components for an anode-connector assembly were constructed using MnZn ferrite for the anode and a 16/84 vol. % Ni/MnZn ferrite for the cermet connector. The components were molded at 69 to 138×$10^6$ Pa (10 to 20 psi×$10^3$), calcined for two hours in vacuum at 800°–1100° C., preferably 1025° C., machined, then sintered for two hours in vacuum at 1225° C. The measured shrinkages in going from the calcined to the sintered stage were as follows:

| Material | Molding Pressure | % Shrinkage Axial | % Shrinkage Radial |
|---|---|---|---|
| MnZn Ferrite anode | 138 × $10^3$ Pa (20 × $10^3$ psi) | 14.5 | 14.5 |
| MnZn Ferrite anode | 103 × $10^6$ Pa (15 × $10^3$ psi) | 15.6 | 15.7 |
| Ni/MnZn Ferrite connector | 103 × $10^6$ Pa (15 × $10^3$ psi) | 10.0 | 10.2 |
| Ni/MnZn Ferrite connector | 69 × $10^6$ Pa (10 × $10^3$ psi) | 11.6 | 11.4 |

We have found that by calcining the parts at an intermediate temperature, e.g., 1025° C., the parts are readily machinable without breakage and have controllable shrinkage during the sintering step at the higher temperature. Alternatively, acceptable machinability in the green state can be obtained by isostatic molding at much higher pressures, e.g., 28×$10^7$ Pa (40×$10^3$ psi).

EXAMPLE 1

A 3.5 cm (1⅜ in.) diam. MnZn ferrite anode and a 1.9 cm (¾ in.) 16/84 vol. % Ni/MnZn ferrite cermet pin were molded at 138×$10^6$ Pa (20×$10^3$ psi) and 69×$10^6$ Pa (10×$10^3$ psi), respectively, to minimize differences in shrinkage, as shown above. The calcined anode was machine threaded 4.3 threads per cm (11 per in.) and the calcined cermet pin was threaded 4.5 threads per cm (11.5 per in.). The sintered pieces had final threads about 5.1 threads per cm (13 per in.). The densities of the components were ≧95% of theoretical. The electrical resistivities of the MnZn ferrite and cermet materials were measured as 0.09 Ω-cm and 0.03 Ω-cm, respectively, at 950° C. in air.

The pin was threaded into the anode and the electrical and mechanical stability of the joint and the total assembly tested by electrolyzing the assembly for 24 hours at 968° C. in a Hall electrolyte consisting of 81% cryolite, 5% $AlF_3$, 7% $CaF_2$, and 7% $Al_2O_3$ by weight. An electrolysis current of 15.3 A applied to the cermet connector gave a current density of 1.0 A/$cm^2$ at the tip of the anode and 5.4 A/$cm^2$ within the cermet pin. The cell voltage was stable throughout the test, an indication of high joint stability, and the sample was intact when removed from the cell.

EXAMPLE 2

The electrical contact resistance of an anode/connector assembly comprising a 16/84 vol. % Ni/MnZn ferrite cermet pin threaded into a MnZn ferrite ceramic anode was measured at 950° C. in air. The procedure was as follows: Two MnZn ferrite cylindrical samples, each 5.08 cm long×4.45 cm in diameter, were prepared for the measurement, one in solid form to be used as a standard (zero internal contact resistance) and the other drilled and threaded to accommodate a 1.9 cm diameter threaded cermet pin. The cermet pin was threaded into the ceramic piece flush with the surface of the ceramic so that both the test sample and the standard sample had the same external dimensions. Platinum contacts were fired onto the ends of the specimens; platinum leads in a 4-probe configuration were used for the electrical connections.

The current-voltage profile of each sample was measured over the current range 0–10 amps-equivalent to a current density of 0–3.5 amps/$cm^2$ in the cermet pin and 0–0.7 amps/$cm^2$ in the ceramic. The profiles are plotted in FIG. 1. With the measurement scheme described, the contact resistance of the threaded joint at a given current is equal to the resistance of the threaded test sample minus the resistance of the standard sample. At 0.1–0.2 amps the joint resistance was 0.090Ω, while at 10 amps the resistance was 0.065Ω.

These values are higher than desirable for commercial application. Lower joint resistance can be obtained by (1) careful matching of the thread size, thread pitch, etc., or (2) through the use of an interfacial metal contact. In the latter case the metal should have a melting point greater than the Hall cell operation temperature, which is typically 950°–960° C. The metal contact is afforded protection from the corrosive effects of the cell environment by the threaded joint. The thickness of the metal contact should be limited to avoid stresses induced by thermal expansion mismatch. This can be achieved, e.g., by plating the cermet connector or by placing a small amount of metal in the threaded anode cavity prior to assembly of the cermet pin at elevated temperature. On assembly at a temperature sufficiently above the cell operating temperature to melt the metal contact, the molten metal is forced along the connector threads to effect, on cooling, a solid-state connection with high contact area. Copper-nickel alloys have been found useful for this purpose.

EXAMPLE 3

Cermet samples containing 16, 25, and 40 volume % Ni and the remainder MnZn ferrite were fabricated for electrical resistivity characterization. Measurements were taken over the temperature range 25°–950° C. using platinum probes and contacts in a 4-terminal arrangement. A plot of log resistivity versus reciprocal temperature for the cermets is shown in FIG. 2. The measurements were made in air. It is evident from the figure that the compositions containing 16 and 25 volume % Ni have negative temperature coefficients, characteristic of semiconducting oxides, while the 40 volume % Ni cermet has a positive temperature coefficient, indicative of metallic behavior. The internal stability of all three cermets at 950° C. in air was demonstrated by noting that the resistivities remained constant for periods ≧40 hours. The cermet containing 40 volume % Ni has a resistivity at 950° of $5\times10^{-4}$ Ω.cm, one-tenth that of anode carbon at the same temperature. A polished specimen of this cermet was examined with the electron microscope and observed to be very dense and to possess an extended internal metal network accounting for the metallic electrical properties. This composition offers the lowest resistance for application as a cermet connector.

DESCRIPTION OF THE DRAWINGS

FIG. 1 shows current versus voltage profiles for the anode/connector assembly of Example 2 (curve A) and for a solid MnZn ferrite sample (curve B) over the range of 0–10 amps.

FIG. 2 is a plot of log resistivity vs reciprocal temperature for (A) 16 vol. %, (B) 25 vol. %, and (C) 40 vol. % Ni/MnZn ferrite cermets of Example 3.

FIG. 3 illustrates one embodiment of the anode in operation in a Hall cell, using a threaded connector. The anode body 10 is held in place by threaded electrical connector 12, which may optionally have the threaded portion 14 wetted by a metal 15 with a melting point above the cell operating temperature. The anode is immersed in the Hall electrolyte 16 through the cell crust 18, with molten Al pool 17.

FIG. 4 illustrates a second embodiment of the invention wherein anode body 20 is held in place by mechanical suspension bar 22. In this instance the cermet connector is primarily a current conductor with the anode mechanically suspended by the suspension bar. The connections of the mechanical suspension to the structure and of the anode connector to the current source are conventional. The current distribution within the anode is improved by the tapered region shown in the lower anode cavity.

We claim:

1. A cermet anode connector for use in an electrolytic cell for molten salt electrolysis wherein the anode is selected from the group consisting of cermets and ceramics, said connector having a lower electrical resistivity than said anode at the operating temperature of said cell and no higher than $1\times10^{-3}$ Ω-cm, said connector comprising at least 31% by volume of metal and no more than 69% by vol. of ceramic.

2. The connector of claim 1 joined to a hollow anode by a threaded joint in the interior of said anode in a region of high temperature.

3. The connector of claim 1 produced by the process of molding a cermet at 5 to $30\times10^{7}$ Pa, calcining said cermet at 800°–1100° C., machining said cermet, and sintering said cermet at a temperature above 1100° C.

4. The connector of claim 1 comprising from 31% to 50% by volume nickel metal and from 50% to 69% by volume manganese zinc ferrite made by the process of blending the metal and ferrite, molding the metal and ferrite at from 69 to $138\times10^{6}$ Pa, to form a part, calcining the molded part at about 800° to 1100° C., machining the part to a final shape, and sintering the part at a temperature above about 1100° C. effective to produce a connector with no more than 8% by volume porosity.

5. An anode assembly in a cell for the electrolysis of molten salts comprising a non-consumable anode selected from the group consisting of cermets and ceramics and a cermet connector comprising at least 31% by vol. metal and up to 69% by vol. ceramic oxide and having a resistivity at the operating temperature of said cell lower than said anode and no more than $1\times10^{-3}$ Ω-cm from said anode to a current source, said anode being joined to said connector in an area of high temperature in the interior of said anode when said cell is in operation.

6. The anode assembly of claim 5 wherein the connector is an externally threaded male article joined to an internally threaded socket in said anode.

7. The anode assembly of claim 5 wherein the anode is supported by mechanical support means separate from the electrical connector and engaging one or more matching grooves in the interior surface of said anode.

8. The anode and connector of claim 5 produced by the process of forming the articles by cold pressing at approximately 5 to $30\times10^{7}$ Pa, calcination at an intermediate temperature of 800° to 1100° C., cooling, machining, and sintering at a higher temperature above 1100° C. effective to form said articles with no more than 8% porosity.

9. The connector of claim 5 produced by the process of molding a mixture of from 31 to 50% by volume Ni metal and from 50% to 69% by volume MnZn ferrite by isostatic pressing at a pressure from 69 to $138\times10^{6}$ Pa to form said connector, calcining said connector at a temperature from 800° to 1100° C., cooling said connector, machining said connector, and sintering said connector at a temperature above about 1100° C. effective to produce said connector having no more than 8 vol. % porosity.

10. A Hall-Heroult cell for the production of aluminum by electrolysis comprising an electrically conductive non-consumable hollow anode and a connector for said anode produced by the process of pressing cermet-forming powders at 69 to $138\times10^{6}$ Pa, to form shaped articles, calcining said articles at 800° to 1100° C., cooling said articles, machining said articles, and sintering said articles at approximately 1225° C., said connector consisting of a cermet comprising at least 31% by volume Ni and not more than 69% by volume MnZn ferrite and having a resistivity lower than said anode of not more than $1\times10^{-3}$ Ω-cm at the operating temperature of said cell, wherein the connection between said anode and connector is made in a region of high temperature in the interior of said anode when said cell is operating.

* * * * *